US007183943B2

(12) United States Patent
Amemiya

(10) Patent No.: US 7,183,943 B2
(45) Date of Patent: Feb. 27, 2007

(54) MODEL RAILWAY TRAFFIC LIGHT APPARATUS AND CONTROL METHOD THEREOF

(75) Inventor: Hiroki Amemiya, Misato (JP)

(73) Assignee: Tomy Company, Ltd., Tokyo (JP)

( * ) Notice: Subject to any disclaimer, the term of this patent is extended or adjusted under 35 U.S.C. 154(b) by 115 days.

(21) Appl. No.: 10/978,483

(22) Filed: Nov. 2, 2004

(65) Prior Publication Data

US 2005/0184199 A1 Aug. 25, 2005

(30) Foreign Application Priority Data

Feb. 25, 2004 (JP) ..... 2004-049069

(51) Int. Cl.
*G08G 1/095* (2006.01)

(52) U.S. Cl. ..... 340/908; 340/691.1; 446/467

(58) Field of Classification Search ..... 340/933, 340/691.1, 691.2; 446/467
See application file for complete search history.

(56) References Cited

U.S. PATENT DOCUMENTS 5,678,789 A * 10/1997 Pipich ..... 246/3
6,600,429 B2 * 7/2003 Zander ..... 340/917

FOREIGN PATENT DOCUMENTS

JP 3-19920 4/1991

* cited by examiner

*Primary Examiner*—Jeffery Hofsass
*Assistant Examiner*—Shirley Lu
(74) *Attorney, Agent, or Firm*—Staas & Halsey LLP

(57) ABSTRACT

A model railway traffic light apparatus, including: at least one signal light; a sensor to detect a timing when a toy train which travels along a rail passes through a predetermined position; and a control section to switch sequentially a series of light turning-on patterns of the signal light and count a period from a first passing of the toy train which is detected by the sensor and until a second passing of the toy train which is just after the first passing and which is detected by the sensor, and to set a switching timing of switching the light turning-on patterns to be variable corresponding to the period.

11 Claims, 9 Drawing Sheets

MODEL RAILWAY TRAFFIC LIGHT APPARATUS AND CONTROL METHOD THEREOF

BACKGROUND OF THE INVENTION

1. Field of the Invention

The present invention relates to a model railway traffic light apparatus and a control method thereof.

2. Description of Related Art

So far a model railway of the so-called N gauge or HO gauge standard has been on the market, and a rail-integrated model railway traffic light apparatus, which is applicable to the model railway, is disclosed in JP-JITSUKO-HEI-03-19920. The traffic light apparatus detects a passing of each wheel of a toy train by a sensor attached to a predetermined position of a rail, and accordingly switches a turning-on pattern of a signal light. For example, at the timing when the front of a toy train passes through, i.e. the timing when the first wheel is detected, the signal light is switched from yellow to red. Then when each pre-set time passes, the signal light is switched in such an order: from red to yellow, and then from yellow to green. Such change of the turning-on pattern is not dependent on the speed of the train which passes through the traffic light apparatus, the length of the train, in other words, not dependent on such traveling conditions as the size of the layout. While such change differs from that of the real railway in that it is carried out only at a time base, but the reality close to the real railway is required.

However, the timing for switching the light turning-on pattern (i.e. the display time of each light turning-on pattern) in the conventional model railway traffic light apparatus is set to a fixed value, causing the presence of the disruption of the reality of the signal light turning-on operation. A typical example can be named in which a relatively long train circles a relatively small endless railway. In this case, the circling period from that when the end of the train, which is in a first circling movement, passes through the traffic light apparatus until that when the front of the train, which is in a circling movement that is just after the first circling movement, passes through the traffic light apparatus becomes extremely short. Therefore, in the case where the front of the train passes through the traffic light apparatus before the signal light is switched back to green, causing such troublesome case to occur where the signal light is only turned on to red and yellow, and in the case where the train circles at a higher speed, the signal light is only turned on to red. Such inconvenience can be solved by accelerating the switching timing of the light turning-on pattern. However, in this case a reality disruption will occur for a large endless railway in that the switching of the light turning-on patterns becomes tight compared to the circling of the train.

SUMMARY OF THE INVENTION

In view of the aforementioned problems, an object of the present invention is accordingly to retain with a high flexibility that is not dependent on the travel conditions the reality concerning the light turning-on operation of the model railway traffic light apparatus.

In accordance with a first aspect of the present invention, there is provided a model railway traffic light apparatus which comprises: at least one signal light; a sensor to detect a timing when a toy train which travels along a rail passes through a predetermined position; and a control section to switch sequentially a series of light turning-on patterns of the signal light and count a period from a first passing of the toy train which is detected by the sensor and until a second passing of the toy train which is just after the first passing and which is detected by the sensor, and to set a switching timing of switching the light turning-on patterns to be variable corresponding to the period.

In accordance with a second aspect of the present invention, there is provided a model railway traffic light apparatus which comprises: at least one signal light; a sensor to detect a timing when a toy train which travels along a rail passes through a predetermined position; and a control section to switch sequentially a series of light turning-on patterns of the signal light and count a period from a first passing of the toy train which is detected by the sensor and until a second passing of the toy train which is just after the first passing and which is detected by the sensor, and to set a switching timing of switching the light turning-on patterns to be earlier so that the period becomes shorter.

According to the second aspect of the invention, preferably, the control section sets the switching timing by dividing the period by a value which corresponds to the number of the light turning-on patterns to calculate each display time of the light turning-on patterns. Also the display time is preferably set to at least one of a predetermined maximum value and a predetermined minimum value: when the display time is set to a value less than the predetermined minimum value, the control section sets the display time to the minimum value; when the display time is set to a value more than the predetermined maximum value, the control section sets the display time to the maximum value.

According to the second aspect of the invention, preferably, a plurality of different operation modes can be set up to specify the series of light turning-on patterns. In this case, preferably the control section switches the light turning-on patterns in accordance with the any one of the operation modes specified by a user. For example, the control section counts the number of times which the model railway traffic light apparatus is turned on and off, and sets the operation modes which corresponds to the counted number of times when a turning-on state of the model railway traffic light apparatus is kept longer than a predetermined time. Also, the control section counts the number of times which the power unit, which is electrically connected to the model railway traffic light apparatus, is turned on and off. Further, when the operation modes have been set, the control section, prior to displaying a series of patterns of an operation mode which has been set, displays as a conformation a special light turning-on pattern which has been set corresponding to each operation mode.

In accordance with a third aspect of the present invention, there is provided a model railway traffic light apparatus control method for controlling a model railway traffic light apparatus which includes a sensor to detect a timing when a toy train which travels along a rail passes through a predetermined position; and a control section to switch sequentially a series of light turning-on patterns of at least one signal light. The method comprises: a first step to begin to count, based on a timing of a first passing of the train, which is detected by the sensor; a second step to specify a counted period at a timing when a second passing of the train which is just after the first passing is detected by the sensor; and a third step to set a switching timing of switching the light turning-on patterns to be variable, corresponding to the counted period.

According to the third aspect of the present invention, preferably, the third step is a step which sets the switching timing to be earlier so that the period becomes shorter. Also preferably, the third step is a step which switches the light turning-on patterns in accordance with any one operation mode specified by a user from a plurality of different operation modes specifying the series of light turning-on patterns.

According to the present invention, the timing of the light turning-on patterns is set to be variable corresponding to the period from the first passing and until the re-passing, making it possible to retain the reality concerning the light turning-on operation of the model railway traffic light apparatus, with a high flexibility that is not dependent on the speed and length of the train, which passes through the traffic light apparatus. That is, not dependent on the so-called travel conditions such as the layout size of the train.

BRIEF DESCRIPTION OF THE DRAWINGS

The invention will become more fully understood from the detailed description given hereinbelow and the accompanying drawings which are given by way of illustrating only, and thus are not intended as a definition of the limits of the invention, and wherein.

DETAILED DESCRIPTION OF THE PREFERRED EMBODIMENTS

First Embodiment

Figure 1:
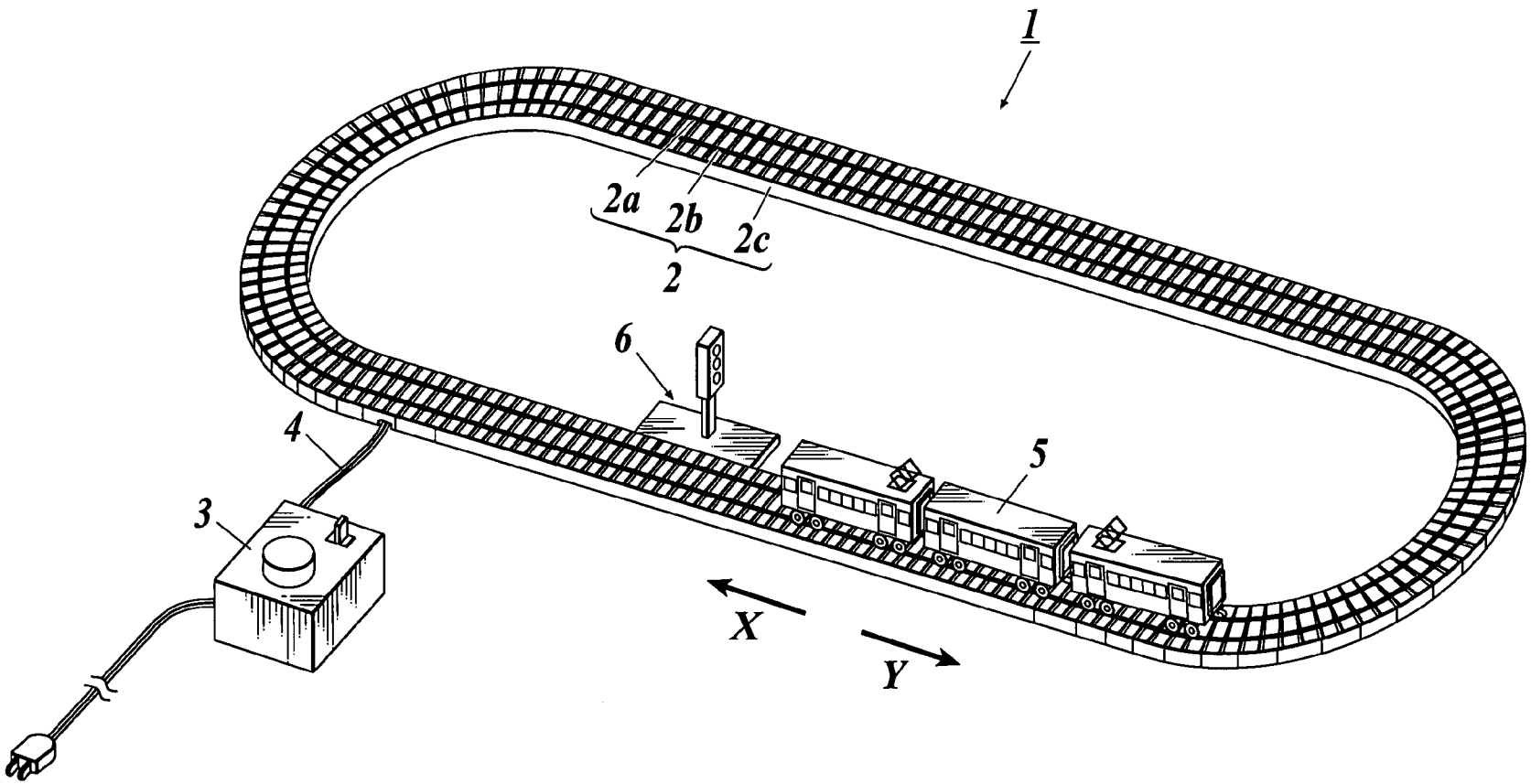
FIG. 1 is a view illustrating one exemplary layout where a model railway traffic light apparatus in accordance with a first embodiment is arranged.

FIG. 1 is a view illustrating one exemplary layout where a model railway traffic light apparatus in accordance with a first embodiment is arranged. A layout 1 is an endless rail where a plurality of linear and gyrose rail portions 2 are incorporated circularly. Each of the rail portions 2 comprises a track bed 2*c* made of an insulating material such as plastic, a pair of rails 2*a*, 2*b* which are attached to the track bed 2*c* and which are made of a stainless conductive material. The electric power (DC voltage or pulse voltage) from a power unit 3 (controller) is supplied to the rails 2*a*, 2*b* through an electric power cord 4 with a connector terminal attached thereto. A toy train 5 mounted on the rail portions 2 comprises a motive power unit whereon a motor is mounted, and receives power supply from a wheel which is in contact with the rails 2*a*, 2*b*. A user adjusts a knob of the power unit 3 to set the DC voltage or the pulse voltage to be variable, allowing the toy train of the layout 1 to circle at a desirable speed. The rail-integrated model railway traffic light apparatus 6 is attached to one portion of the layout 1. The necessary electricity for operating the traffic light apparatus 6 is supplied from the power unit 3 through an electric power cord which is not shown in the figure.

Figure 2:
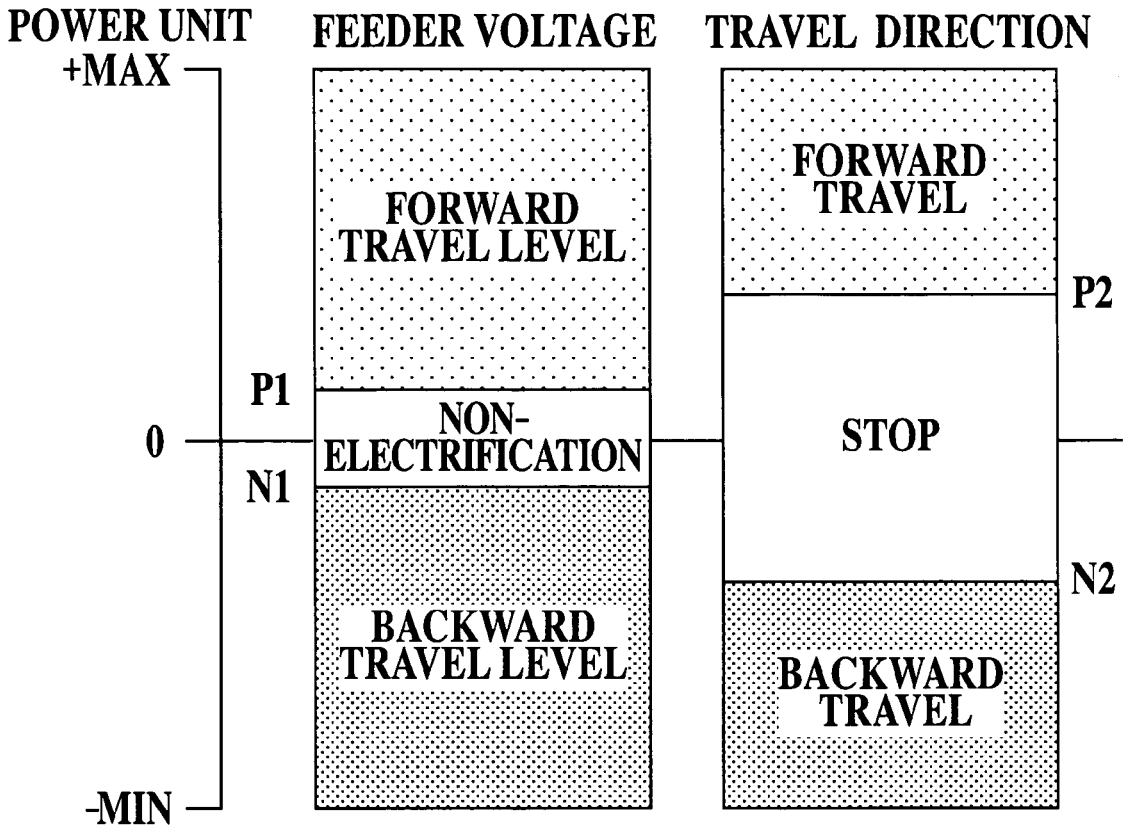
FIG. 2 explains the traveling control of a toy train.

FIG. 2 is a figure explaining the traveling control of the toy train 5. The feeder voltage outputted from the power unit 3 is adjusted in a range of the maximum value (+MAX) and the minimum value (−MIN), allowing one of the states of "forward travel", "stop", "backward travel" to be determined. The "forward travel" means the toy train 5 travels in a direction where the turning-on state of the traffic light apparatus 6 is visible (X direction in FIG. 1). A forward travel level is a level where the feeder voltage exceeds P1, but actually the train will not travel when the feed voltage does not exceed P2 (P2>P1). The "backward travel" means the toy train 5 travels in a direction where the turning-on state of the traffic light apparatus 6 is not visible (Y direction in FIG. 1). A backward travel level is a level where the feeder voltage does not exceed N1, but actually the train will not travel when the feed voltage does not exceed N2 (N2<N1). The area where the feeder voltage is higher than N1 but lower than P1 is treated as a non-electrification area.

Figure 3:
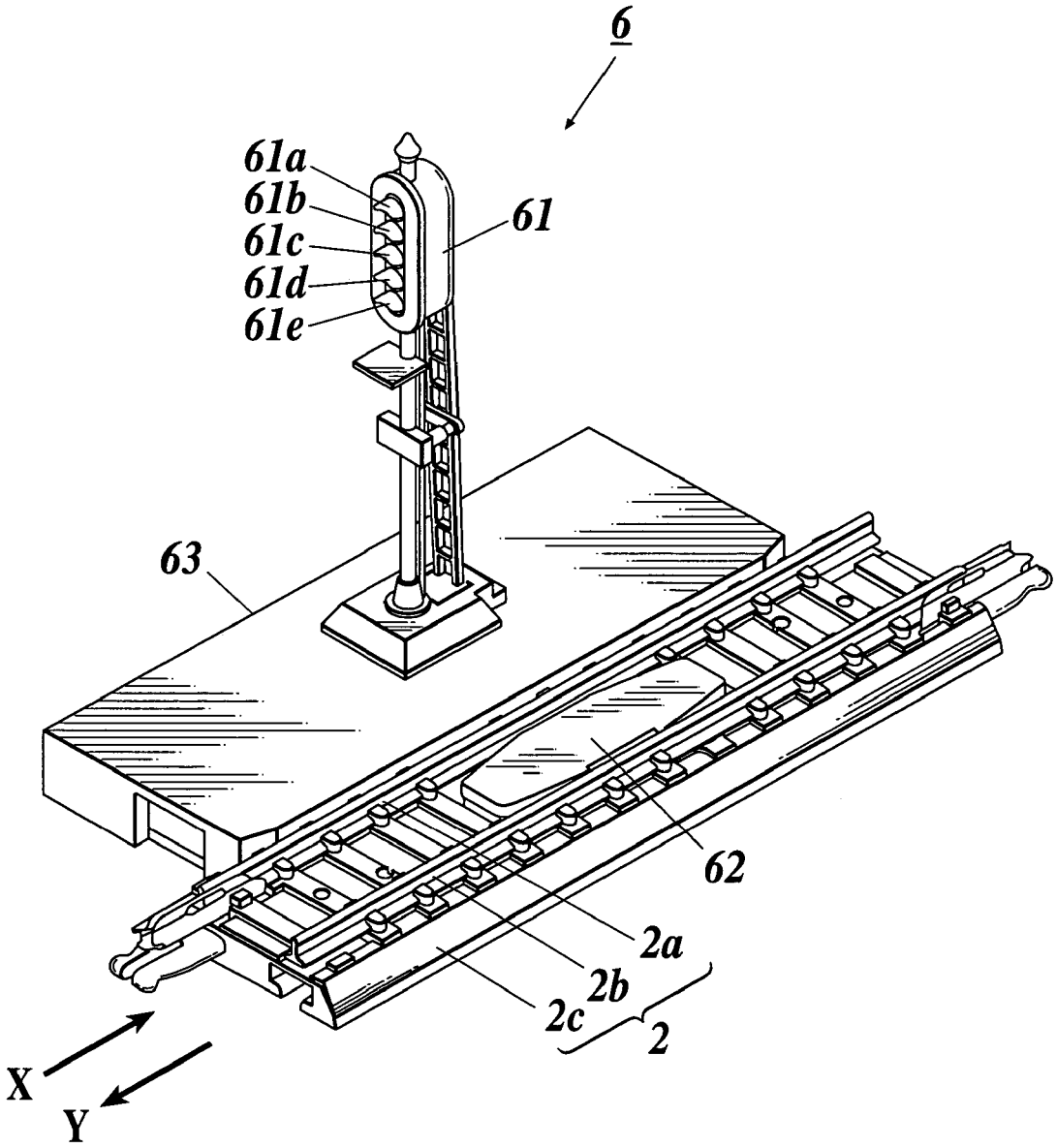
FIG. 3 is a perspective view of the model railway traffic light apparatus.

FIG. 3 is a perspective view of the model railway traffic light apparatus 6. The model railway traffic light apparatus mainly comprises a main body 61, a sensor 62, a control section 63 and a short and linear rail portion 2. The main body 61 has a shape that imitates a real railway traffic light apparatus and has a plurality of signal lights lined therein, which are formed with light emitting diodes. A 5-signal light model traffic light apparatus is shown as an example in FIG. 3 where 5 signal lights, i.e. 61*a*–61*e*, are lined up from upward to downward in the order of "yellow 3, yellow 2, red, yellow 1, green 1". The 5-signal light traffic light apparatus has 5 turning-on patterns, i.e. "stop", "warning", "caution", "decelerate" and "go". The "stop" means the train is stopped until the next signal, and only the middle signal light 61*c* is turned on, becoming red. The "warning" means travel at a speed less than 25 km/h, and the first signal light from top 61*a* and the second signal light from bottom 61*d* are turned on, becoming "yellow 1 yellow 3". The "caution" means travel at a speed less than 45 km/h (or 55 km/h), only the second signal light from bottom 61*d* is turned on, becoming "yellow 1". The "decelerate" means travel at a speed less than 75 km/h (or 65 km/h), the second signal light from top 61*b* and the lowest signal light 61*e*, becoming "green 1 yellow 2". The "go" means travel at a speed less than the maximum speed, and only the lowest signal light 61*e* is turned on, becoming "green 1". In addition to the above turning-on patterns, there is another turning-on pattern called "holding speed" between "decelerate" and "go", which means traveling at a speed less than 105 km/h, and "green 1 yellow 2" flash. Such a turning-on pattern is actually used in the keihin bullet train system. A 6-signal light traffic light apparatus designated by law, while not used in reality, has a signal light of "green 2" on top of the "yellow 3", i.e. a "high speed" turning-on pattern following the "go" turning-on pattern. The "high speed" means traveling at a speed of higher than 130 km/h, the first one from top and the lowest one are turned on, becoming "green 1 green 2". In addition, programs of the signal lights are made according to the 6-signal light traffic light apparatus.

Figure 4A:
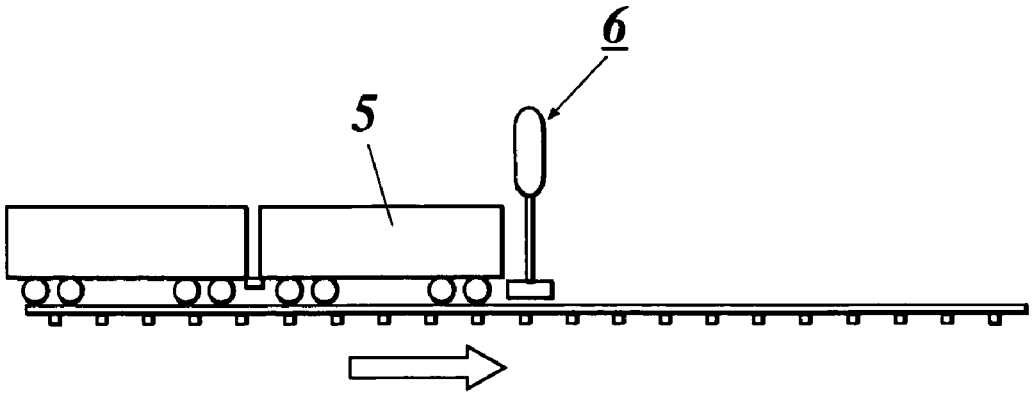
FIG. 4A and FIG. 4B are views respectively explaining that the toy train is entering or exiting the model railway traffic light apparatus.
Figure 4B:
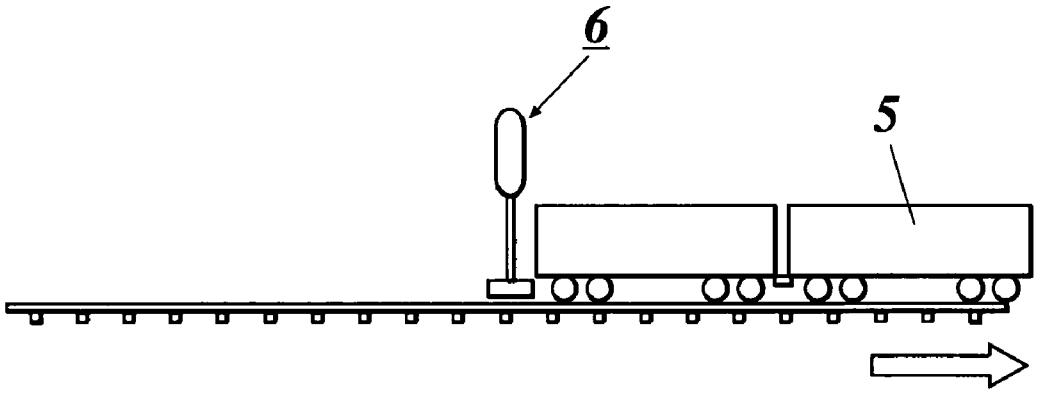

The sensor 62 detects the timing when the toy train 5, which travels on the rails 2*a*, 2*b*, passes through a predetermined position. The sensor 62 is attached to the track bed 2*c* which is situated in the middle of the pair of rails 2*a*, 2*b*. As the sensor 62, the applicant of the present invention uses a touch sensor which has been adopted in the on-the-market automatic traffic light apparatus (product No. 5556 or 5551). With this kind of sensor 62, every time each wheel of the toy train 5 passes through the sensor 62, a detection signal of H level is outputted as a pulse. Therefore, when each wheel of the toy train 5 passes through the sensor 62, the pulses equivalent to the number of the wheels are outputted in succession as the detection signal. As shown in FIG. 4A, from a series of pulses generated by the sensor 62, the timing when the first pulse is generated can be caught as the timing when the front of the toy train 5 passes through the traffic light apparatus 6 (entering timing). As shown in FIG. 4B, from the series of pulses, the timing when the last pulse is generated can be caught as the timing when the end of the toy train 5 passes through the traffic light apparatus 6 (exiting timing). In addition to the relatively inexpensive touch sensor, a light sensor, a magnetism sensor or the like can be used as the sensor 62 for detecting the passing timing of the toy train 5.

The control section 63 switches sequentially a series of the turning-on patterns of the signal lights of 61*a*–61*e*, and sets the timing for switching the turning-on patterns to be variable. The explanation is detailed later. The switching timing depends on the period from the time when the sensor detects the passing of the toy train 5 and until the time when the next time the sensor detects the passing of the toy train 5, and the period can be set to be shorter.

While shown in FIG. 3 is a 5-signal light traffic light apparatus, the present invention is not limited to this, but can be broadly applied to a traffic light apparatus which has at least one signal light (e.g. from 2-signal light traffic light apparatus to 6 signal light traffic light apparatus). The 6-signal light traffic light apparatus designated by law is used as an example to explain the concrete light turning-on operation. In this case, the 6 signal lights are lined up from upward to downward in an order of "green 2, yellow 3, yellow 2, red, yellow 1, green 1". The "red" means "stop" (display time=T1), the "yellow 1 yellow 3" means "warning" (display time=T2), the "yellow 1" means "caution" (display time=T3), the "green 1 yellow 2" means "decelerate" (display time=T4), the "green 1" means "go" (display time=T5), and the "green 1 green 2" means "high speed" (display time=T6). In addition, there is also a light turning-on operation called "holding speed" which flashes "green 1 yellow 2" between "decelerate" and "go" (display time=T4*f*).

Figure 5A:
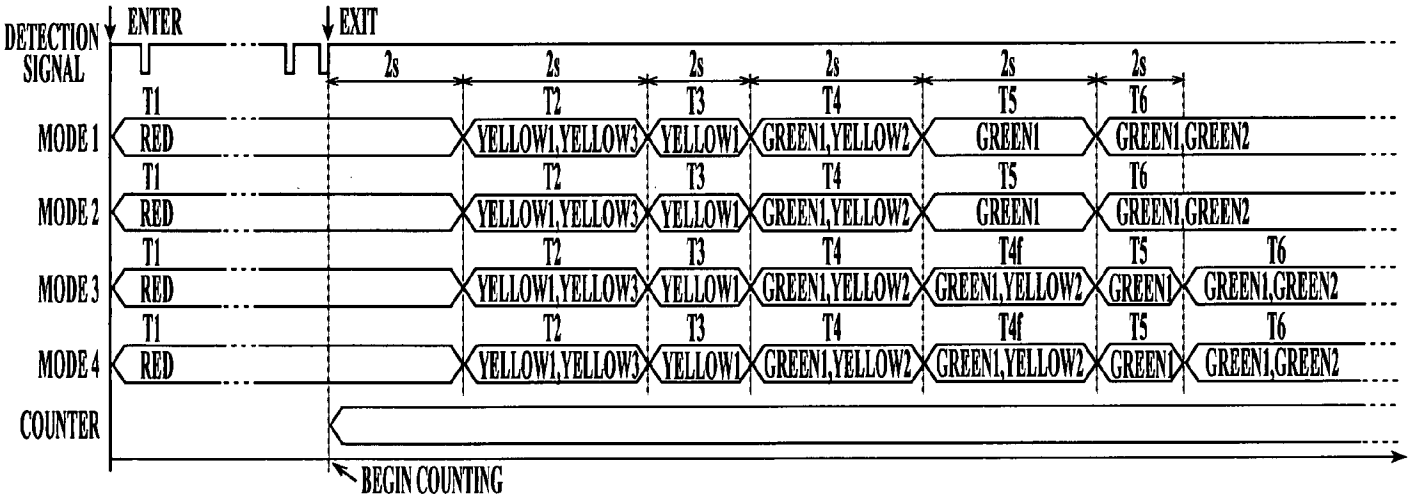
FIG. 5A and FIG. 5B explain operation modes of the model railway traffic light apparatus.
Figure 5B:
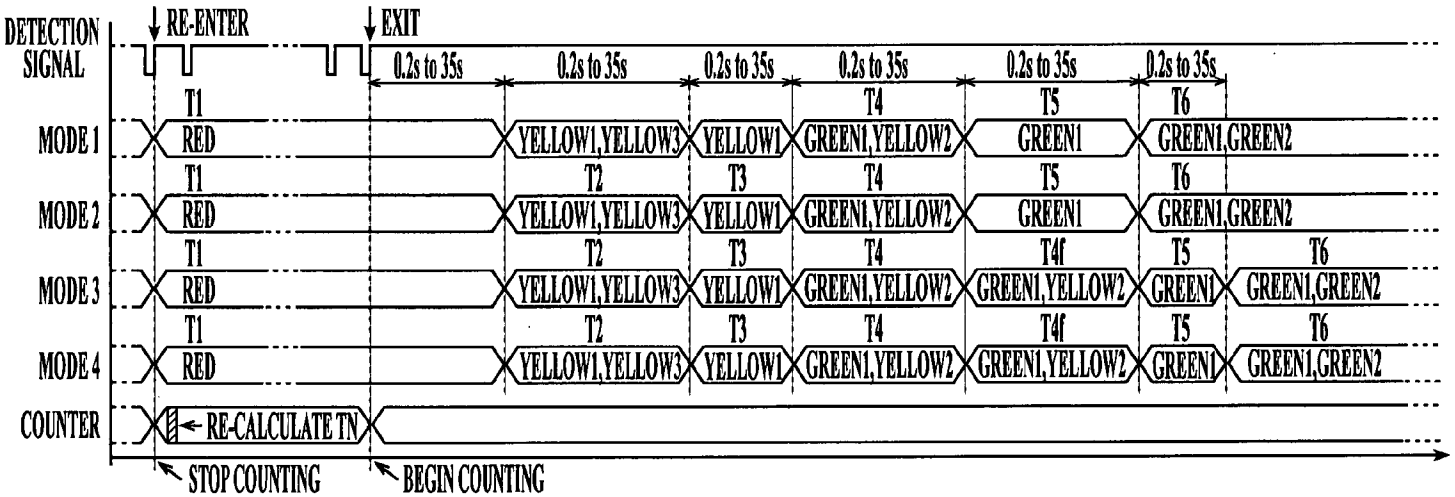
Figure 6:
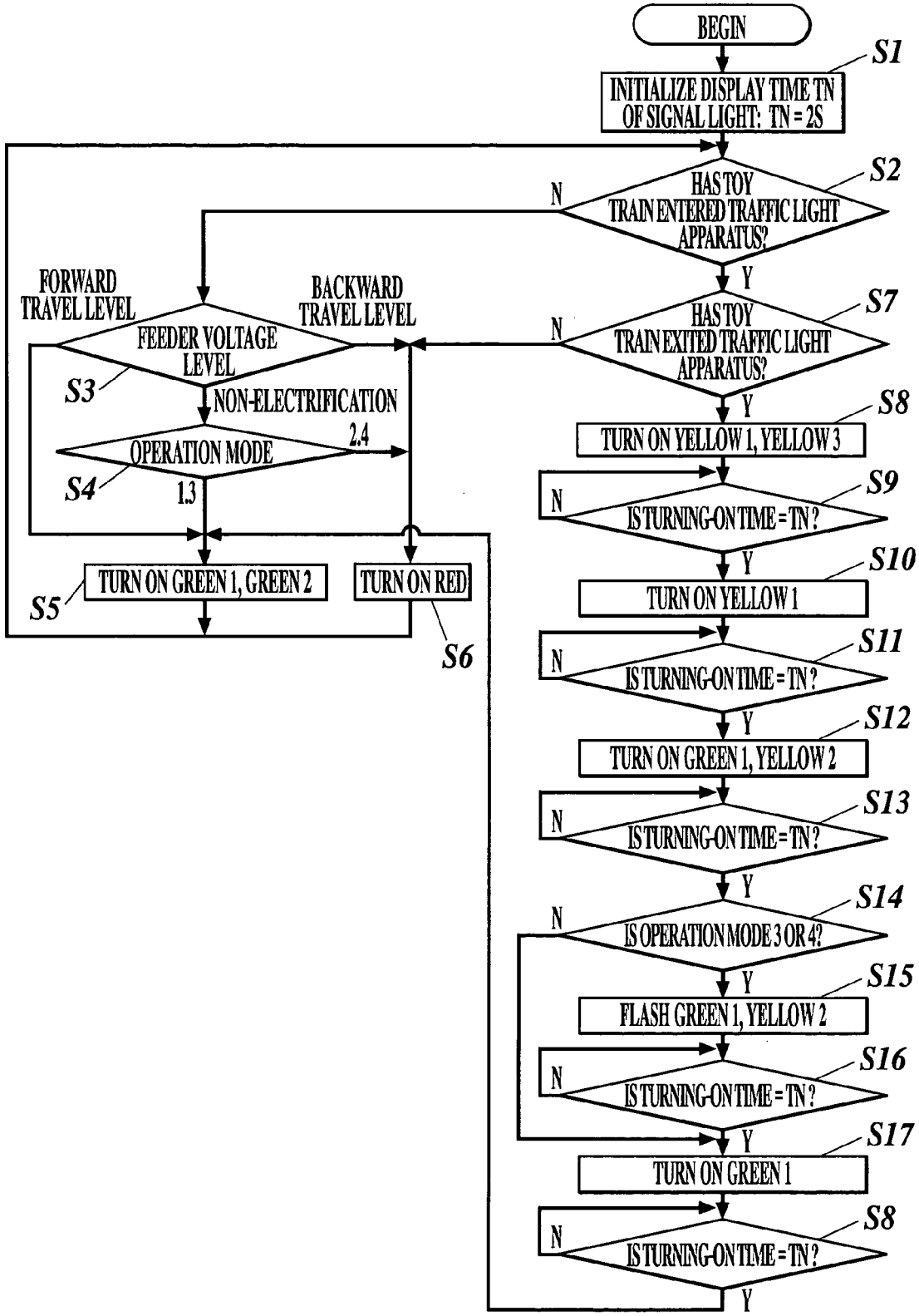
FIG. 6 is an operation flow chart of the model railway traffic light apparatus.

FIG. 5A and FIG. 5B explain operation modes of the model railway traffic light apparatus and FIG. 6 is an operation flow chart of the model railway traffic light apparatus. In the traffic light apparatus 6, four operation modes are set to specify a series of light turning-on patterns, and the light turning-on patterns are switched sequentially according to any one of the operation modes specified by a user. In the present embodiment, while as an example, the display times T2–T5, including the above T4*f*, are set to the same time Tn, they can be set separately. In the present embodiment an endless layout 1 is assumed, so a circling period Ta is defined as the period from the toy train 5 passes through the traffic light apparatus 6 and until the next time the toy train 5 passes therethrough. The circling period Ta varies with such so-called traveling conditions as the size of the layout, the speed of the toy train 5, or the length of the train.

First, on turning on electric power of the power unit 3, electricity is supplied to the model railway traffic light apparatus 6 and the rails 2*a*, 2*b*. The control section 63 sets, for example, 2 s as the initial value of the display time Tn of the signal light (step 1). The display time Tn is adjustable corresponding to the subsequent processing in a range of the predetermined minimum value and the predetermined maximum value.

In step 2, the control section 63 checks whether the toy train 5 has entered the traffic light apparatus 6 based on the detection signal from the sensor 62. If the checking result of step 2 is NO, i.e. the toy train 5 has not entered the traffic light apparatus 6, then go to step 3. In step 3, based on the feeder voltage supplied from the rail portion 2, whether the current electrification state is in the forward travel level, the backward travel level, or the non-electrification level is determined. In the case of the forward travel level, i.e. in the case where the toy train 5 travels forward, the light turning-on pattern of the traffic light apparatus 6 is set to "green 1 green 2" (step 5). In contrast to this, in the case of the backward travel level, i.e. in the case where the toy train 5 travels backward, the turning-on pattern is set to "red" (step 6). And in the case of the non-electrification level, go to step 4, and whether the current operation mode is one of the modes of "1, 3" or one of the modes of "2, 4" is further determined. In the former case, the processing in step 5 is carried out, and in the latter case, the processing in step 6 is carried out. The light turning-on patterns set in steps 5, 6 are kept until the toy train 5 enters the traffic light apparatus 6.

When the toy train 5 enters the traffic light apparatus 6, the checking result of the step 2 changes from NO to YES, and whether the toy train 5 has exited the traffic light apparatus 6 is checked (step 7). In the case where the toy train 5 has entered the traffic light apparatus 6 but has not yet exited therefrom, because the checking result of step 7 is NO, the light turning-on pattern is set to "red" (step 6). Therefore, at the timing when the front of the toy train 5 has passed through the traffic light apparatus 6, the traffic light apparatus 6 is turned on to red, and such light turning-on pattern is kept until at least the entering train 5 exits the traffic light apparatus 6.

When the entering train 5 exits the traffic light apparatus 6, the checking result of step 7 changes from NO to YES, and then go to step 8. In step 8, the light turning-on pattern is switched from "red" to "yellow 1 yellow 3", and at the same time, the counter of the control section 63 begins to count up. In step 9 which follows step 8, whether the time is up, i.e. whether "yellow 1 yellow 3" has been displayed for the display time Tn, is determined. The determination processing of step 9 is repeated until the time is up. When the time is up, go to step 10. In addition, the switching to "yellow 1 yellow 3" in step 8 can be carried out under the condition that the display time Tn has passed from the timing when the toy train 5 has exited from the traffic light apparatus 6 (refer to FIG. 5A and FIG. 5B).

In step 10, the light turning-on pattern is switched from "yellow 1 yellow 3" to "yellow 1", and at the same the counter begins to count up newly. In step 11 which follows step 10, whether the time is up, i.e. whether the "yellow 1" has been displayed for the display time Tn, is determined. The determination processing in step 11 is repeated until the time is up. When the time is up, go to step 12.

In step 12, the light turning-on pattern is switched from "yellow 1" to "green 1 yellow 2", and at the same time, the counter begins to count up newly. In step 13 which follows step 12, whether the time is up, i.e. whether the "green 1 yellow 2" has been displayed for the display time Tn, is determined. The determination processing in step 13 is repeated until the time is up. When the time is up, go to step 14.

In step 14, whether the operation mode is one of the modes "3, 4" is checked. In the case where the operation mode is one of the modes "1, 2", skip step 15 and step 16, go to step 17, and switch the light turning-on pattern from "green 1 yellow 2" to "green 1". In contrast to this, in the case where the operation mode is one of the modes "3, 4" which have one more light turning-on pattern than the operation modes "1, 2", change to flash "green 1 yellow 2" (step 15). Then after this light turning-on pattern has been kept for the display time Tn (step 16), switch from the flashing of "green 1 yellow 2" to the turning-on of "green 1" (step 17).

At the time when the light turning-on pattern is switched to "green 1" in step 17, the counter begins to count up newly. In step 18 which follows step 17, whether the time is up, i.e. whether the "green 1" has been displayed for the display time Tn, is determined. The determination processing in step 18 is repeated until the time is up. In contrast to this, when the time is up, go to step 5, and switch the light turning-on pattern from "green 1" to "green 1 green 2".

From the above explanation, it is clear that the operation modes of 1, 2 are in common with each other in the sense that the 6 light turning-on patterns of "red→yellow 1 yellow 3→yellow 1→green 1 yellow 2→green 1→green 1 green 2" are transited sequentially, and that the operation modes of 1, 2 are different with each other only in the aspect that whether the "red" is present or absent in the backward travel level. The operation modes of 3, 4 are in common with each other in the sense that the 7 light turning-on patterns of "red→yellow 1 yellow 3→yellow 1→green 1 yellow 2→green 1 yellow 2 (flash)→green 1→green 1 green 2" are transited sequentially, and the operation modes of 3, 4 are different with each other only in the aspect that whether the "red" is present or absent in the backward travel level.

Figure 7:
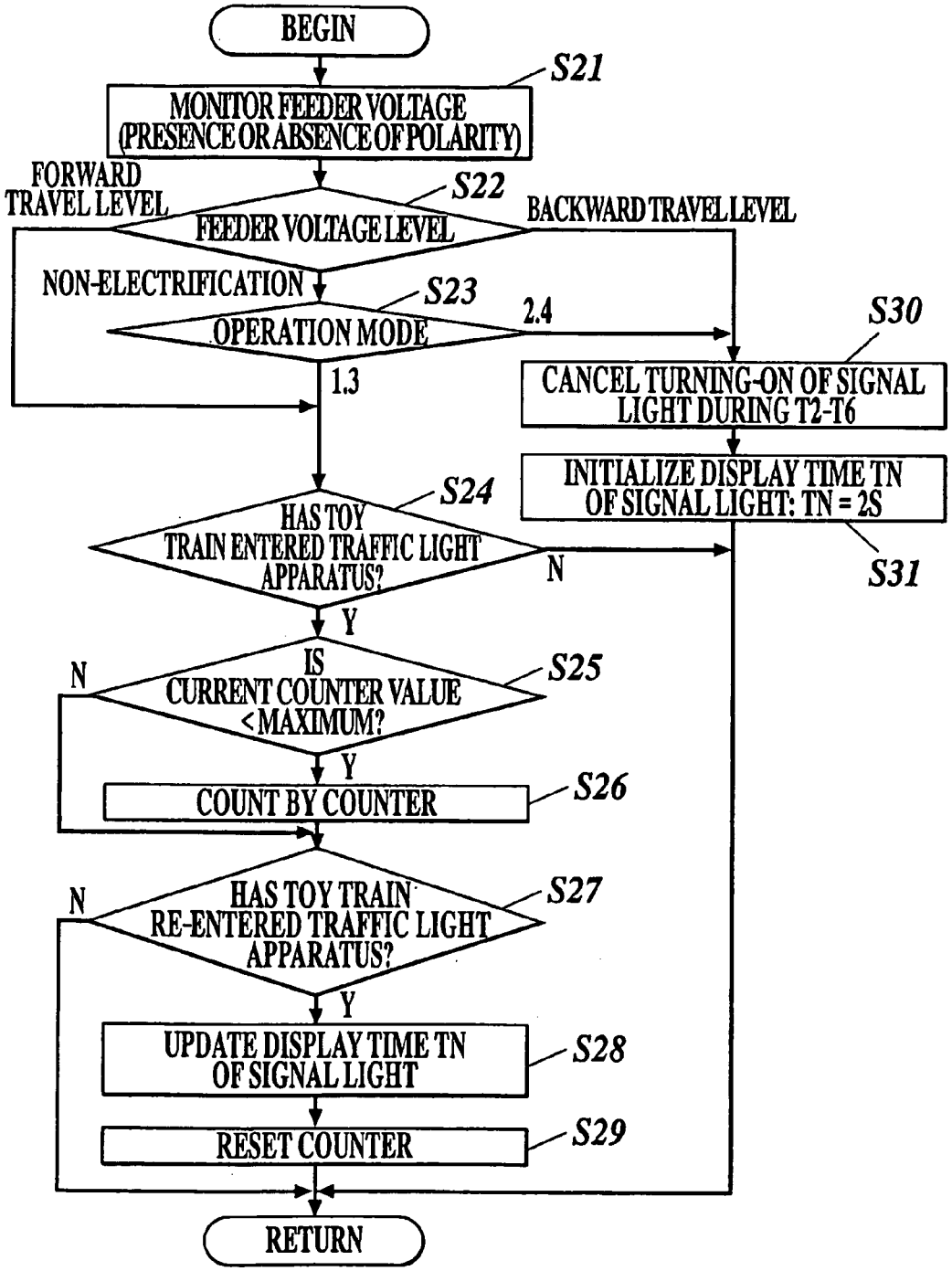
FIG. 7 is an operation flow chart of calculating.

FIG. 7 is a flow chart of the circling period calculation and interruption operation. The series of operations shown in FIG. 7 are repeatedly executed at fixed intervals, e.g. every 0.1 s. The counter of the control section 63 counts the time from that the toy train 5 exits the traffic light apparatus 6 and until that next time the toy train 5 enters traffic light apparatus 6, and calculate the circling period Ta. The circling period Ta is, when a single train 5 travels on the endless layout 1, the time that the toy train 5 circles. However, note that when a plurality of connected trains 5 travel in such layout 1, the circling period Ta is the time from that the end of the trains 5 passes through the traffic light apparatus 6, and until that the front of the trains 5 passes therethrough.

First, the control section 63 monitors the current feeder voltage (presence or absence of the polarity) (step 21), and carries out case handling based on the feeder voltage and the operation modes. In the case where the feeder voltage is forward travel level, and the operation modes 1, 3 are in the state of non-electrification, then go to step 24, and prepare to count the necessary circling period Ta for the calculation of the display time Tn. In contrast to this, in the case where the feeder voltage is backward travel level and the operation modes 2, 4 are in the state of non-electrification, the turning-on of the signal lights is cancelled (step 30), and after the display time Tn is reset to the initial value (Tn=2 s), the current cycle is ended.

In step 24, whether the toy train 5 has entered the traffic light apparatus 6, specifically, whether the end of the toy train 5 has passed through the sensor 62, is checked. When the checking result of step 24 is NO, the current cycle is ended without counting the circling period Ta. In contrast to this, when the checking result of step 24 is YES, then go to step 25.

In step 25, whether the current value of the counter (the initial value is 0) has reached the maximum value is checked. When the current value has not reached the maximum value, then count up (step 26), when the current value has reached the maximum value, step 26 is then skipped, allowing the value of the counter, which has been set to the initial value, to be counted up at the timing when the end of the toy train 5 passes through the traffic light apparatus 6.

In step 27, whether the front of the toy train 5 has re-entered the traffic light apparatus 6 is checked. If the checking result is NO, then the current cycle is ended. Therefore, from when the toy train 5 passes through the traffic light apparatus 6 and until the end of the toy train 5 re-enters the traffic light apparatus 6, and when the value of the counter has not reached the maximum value, the counting-up by step 26 is repeated. When the toy train 5 has re-entered the traffic light apparatus 6, the checking result of step 27 changes from NO to YES, and go to step 28. In step 28, the current value of the counter is specified as the circling period Ta, and the display time Tn is updated based on the circling period Ta. Specifically, as shown in the following equations, by dividing the counted circling period Ta by a value corresponding to the number of the light turning-on patterns, each display time corresponding to each turning-on pattern is obtained.

Calculation of the display time:

For operation modes 1, 2: $Tn=Ta/6$

For operation modes 3, 4: $Tn=Ta/7$

In addition, at least one of the minimum value Tlow and the maximum value Thigh is set in the display time Tn (in the present embodiment, both are set). When the counted display time Tn is less than the minimum value Tlow (e.g. 0.2 s (2 s for "red" only)), the display time Tn is set to the minimum value Tlow. When the counted display time Tn is more than the maximum value Thigh (e.g. 35 s), the display time Tn is set to the maximum value Thigh. Then in the subsequent step 29, the value of the counter is re-set, and the current cycle is ended.

The control section 63 applies at any time the display time Tn calculated by the processing shown in FIG. 7 to the interruption operation in the processing shown in FIG. 6, making it possible to set flexibly an optimal switching timing of the light turning-on pattern, which matches such so-called travel conditions as the size of the layout 1, the speed of the toy train 5, or the length of the toy train 5. When the circling period Ta becomes shorter (e.g. a small size of the layout 1; when the toy train 5 travels at a high speed; a long train 5), as shown in FIG. 5A the display time Tn also becomes shorter, hence the switching timing of the light turning-on pattern becomes earlier. On the other hand, when the circling period becomes longer (a large size of the layout 1; when the toy train 5 travels at a low speed; a short train 5), as shown in FIG. 5B the display time Tn also becomes longer, hence the switching timing of switching the light turning-on pattern becomes later. The circling period Ta is updated at any time, making it possible to set up a flexible timing which follows up the changing travel conditions. As a result, according to the embodiment, the reality concerning the light turning-on operation of the model railway traffic light apparatus 6 is retained with a high flexibility that is not dependent on the travel conditions.

In the above embodiment the explanation is made to the example where the switching timing for switching the light turning-on patterns is set to be earlier so that the circling period Ta becomes shorter. However the invention is not limited to this, rather, it is applicable broadly to the control which sets the switching timing to be variable corresponding to the circling period Ta. Therefore, for some necessary reason other than the reality of the light turning-on operation, the switching timing can be set to be later so that the circling period Ta becomes longer.

Second Embodiment

Figure 8:
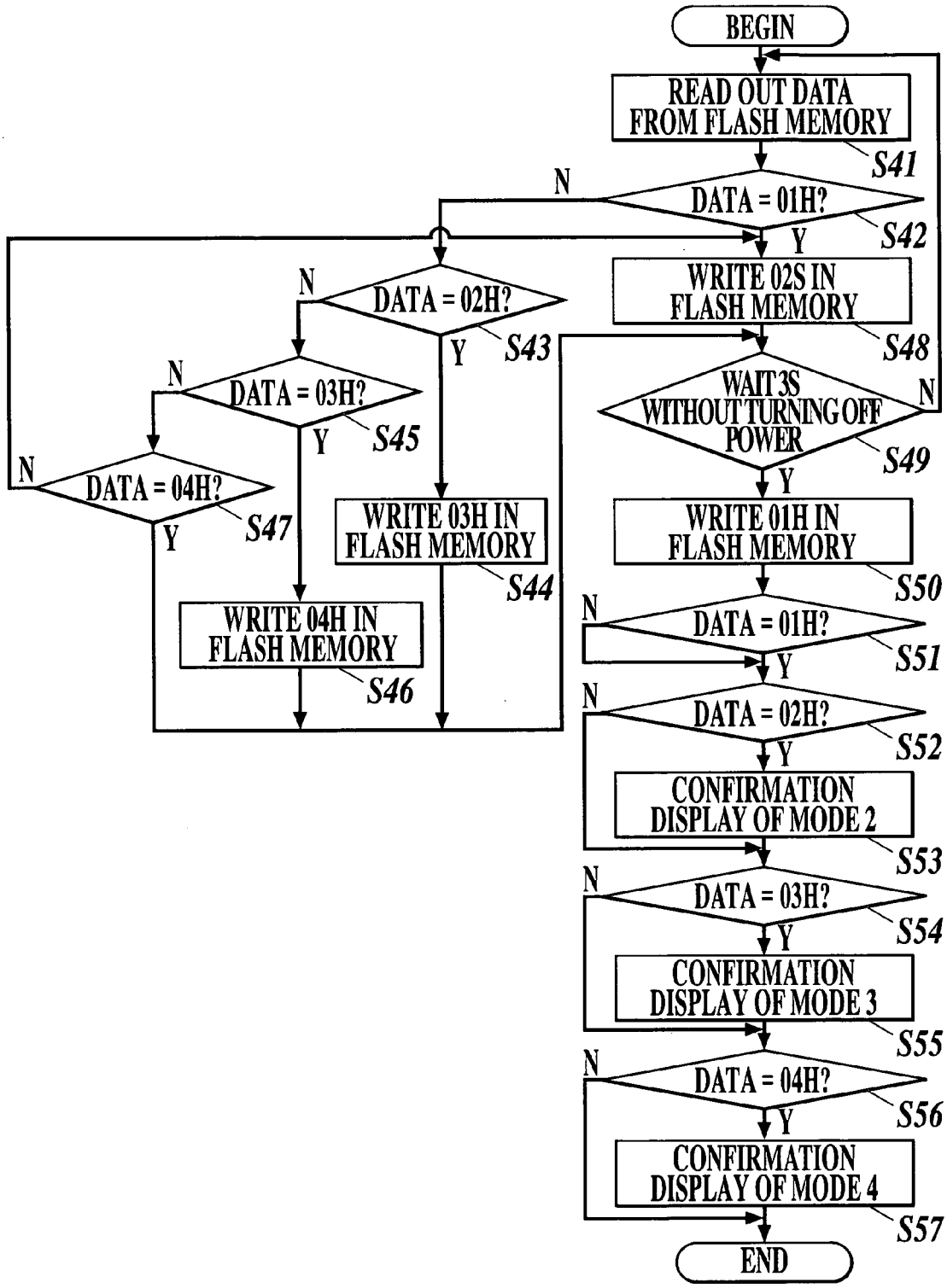
FIG. 8 is a setting flow chart of an operation mode in accordance with a second embodiment.
Figure 9:
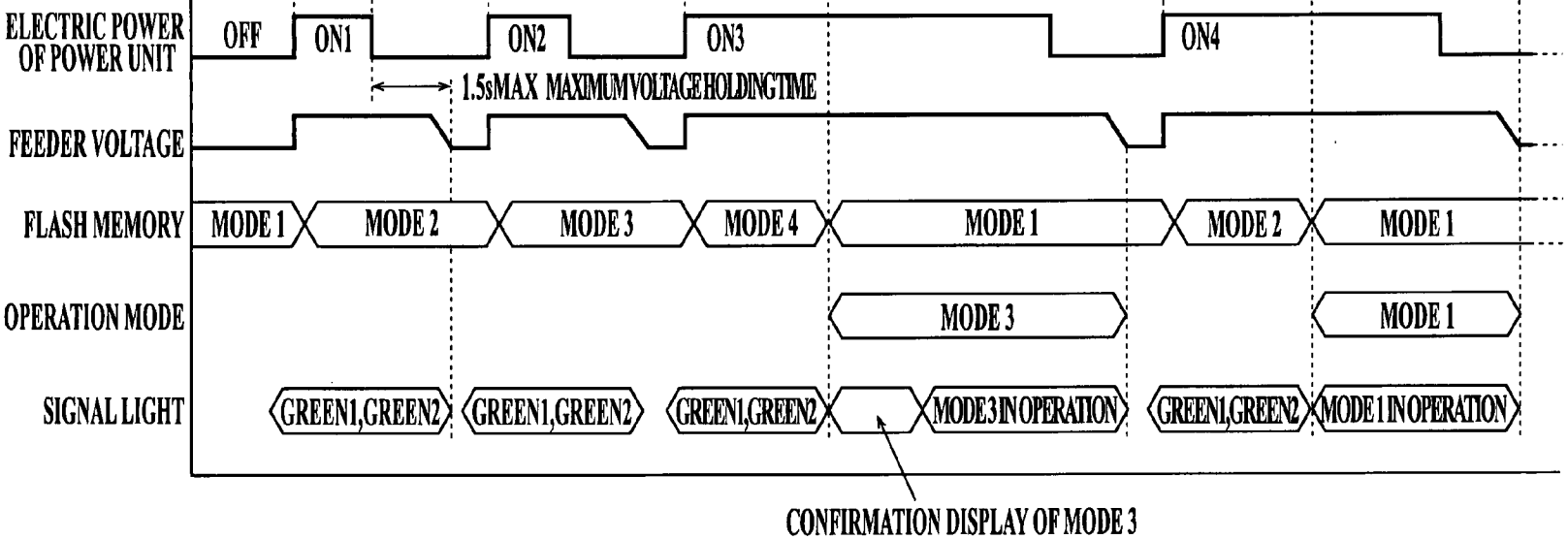
FIG. 9 illustrates one exemplary setting of the operation modes.

The present embodiment relates to a setting method of the operation modes based on the instruction from a user. FIG. 8 is a setting flow chart of the operation modes in accordance with the present embodiment and FIG. 9 is a figure illustrating one exemplary setting of the operation modes. In addition, as a prerequisite for implementing the present processing, a flash memory (not shown in the figure), in which data is retained even when the power is turned off, is incorporated in the control section 63.

First, in step 41, on turning the electric power of the power unit 3, the control section 63 reads out the data stored in the flash memory. Data corresponding to the operation mode 1 is assumed to be represented by "01h", the operation mode 2 by "02h", the operation mode 3 by "03h" and the operation mode 4 by "04h". Next, in step 42, when the data read out from the flash memory (hereinafter referred as read-out data) is "01h", then go to step 48 which is to be explained; when the read-out data is not "01h", go to step 43. In step 43, when the read-out data is "02h", after the data of "03h" is written in the flash memory (step 44), go to step 49. On the other hand, in step 43, when the read-out data is not "02h", go to step 45, and whether the read-out data is "03h" is further checked. When the read-out data is "03h", go to step 46, and after the data of "04h" is written in the flash memory, go to step 49. In step 45, when the read-out data is not "03h", go to step 47. When the read-out data is "04h", go to step 49; otherwise go to step 48. In step 48, the data of "02h" is written in the flash memory. In the subsequent step 49, as the mode determining time for determining the operation mode, wait for, e.g. 3 s, without turning off the power. When the determining result is NO, then return to step 41; when the determining result is YES, then go to step 50. In step 50, the data of "01h" is written in the flash memory.

In the processing after step 51, one of the operation modes 1–4 is set corresponding to the read-out data which is read out from the flash memory in step 41 (note that this is not the data which is written in the flash memory in step 50). When the read-out data is "01h", the normal operation mode 1 is set. Note that in the operation mode 1, unlike in other operation modes of 2–4, a confirmation display for the user, indicating it is mode 1, is not carried out. When the read-out data is "02h", the operation mode 2 is set, and at the same time, a confirmation indicating that it is operation mode 2, which is from the YES determination of step 52, is displayed (step 53). When the read-out data is "03h", the operation mode 3 is set, and at the same time, a confirmation indicating that it is operation mode 3, which is from the YES determination of step 54, is displayed (step 55). When the read-out out data is "04h", the operation mode 4 is set, and at the same time, a confirmation indicating that it is operation mode 4, which is from the YES determination of step 56, is displayed (step 57).

On setting up the operation modes of 2–4, prior to displaying the series of patterns in the set-up operation modes, a special light turning-on pattern which is set corresponding to each operation mode is displayed as a confirmation for the user. For example, in the operation mode 2, all the signal lights are turned on for 2 seconds; in the operation mode 3, all the signal lights flash 2 seconds at intervals of 0.4 second; and in the operation mode 4, only the red signal light flashes 2 seconds at intervals of 0.4 second.

In this way, in the present embodiment, in order to set the operation mode, the user turns on and off the electric power of the power unit 3, which is electrically connected to the traffic light apparatus 6, for the necessary number of times. The control section 63 of the traffic light apparatus 6 counts the number of the times that the user turns on and off (the number of the times of the feeder voltage changes), and sets the operation mode which corresponds to the number of the times when the turning-on state is kept longer than a predetermined time. Then once an operation mode is determined, the data in the flash memory is re-set automatically to the data of "01h" which corresponds to the operation mode 1. According to the embodiment, it is possible for the user to set various operation modes easily, making it possible to further improve the added value and the commodity appeal of the model railway traffic light apparatus 6.

Although the invention has been explained according to the embodiments, it should also be understood that the invention is not limited to the embodiments and that various changes and modifications may be made to the invention from the gist thereof. For example, in the above embodiment, the electric power of the model railway traffic light apparatus 6 is turned on/off through the operation of the power unit 3. However, an electric power switch can be disposed in the traffic light apparatus 6, hence the traffic light apparatus 6 can be turned on/off directly by the switch.

The entire disclosure of Japanese Patent Application No. 2004-049069 filed on Feb. 25, 2004 including specification, claims, drawings and summary is incorporated herein by reference in its entirety.

What is claimed is:

1. A model railway traffic light apparatus, comprising: at least one signal light;

a sensor to detect a timing when a toy train which travels along a rail passes through a predetermined position; and a control section to switch the at least one signal light in a predetermined series of light turning-on patterns, to count a period from a first passing of the toy train detected by the sensor to a second passing of the toy train detected by the sensor which is just after the first passing and to set a switching interval of the switching according to the counted period.

2. A model railway traffic light apparatus, comprising:

at least one signal light;

a sensor to detect a timing when a toy train which travels along a rail passes through a predetermined position; and a control section to switch the at least one signal light in a predetermined series of light turning-on patterns, to count a period from a first passing of the toy train detected by the sensor to a second passing of the toy train detected by the sensor which is just after the first passing and to set a switching interval of the switching to be shorter when the counted period is shorter.

3. The model railway traffic light apparatus as claimed in claim 2, wherein the control section sets the switching interval by dividing the period by a value which corresponds to the number of the light turning-on patterns to calculate each display time of the turning-on patterns.

4. The model railway traffic light apparatus as claimed in claim 3, wherein the display time is set to at least one of a predetermined maximum value and a predetermined minimum value, when the display time is set to a value less than the predetermined minimum value, the control section sets the display time to the minimum value; when the display time is set to a value more than the predetermined maximum value, the control section sets the display time to the maximum value.

5. The model railway traffic light apparatus as claimed in claims 1 or 2, further comprising a plurality of different operation modes to specify the series of light turning-on patterns, wherein the control section switches sequentially the light turning-on patterns in accordance with any one operation mode specified by a user from the operation modes.

6. The model railway traffic light apparatus as claimed in claim 5, wherein the control section counts the number of times which the model railway traffic light apparatus is turned on and off, and sets the operation modes corresponding to the number of times when a turning-on state of the model railway traffic light apparatus is kept longer than a predetermined time.

7. The model railway traffic light apparatus as claimed in claim 6, wherein the control section counts the number of times which a power unit, which is electrically connected to the model railway traffic light apparatus, is turned on and off.

8. The model railway traffic light apparatus as claimed in claim 5, wherein when the operation modes have been set, the control section, prior to displaying a series of light turning-on patterns of an operation mode which has been set, displays as a confirmation a special light turning-on pattern which has been set corresponding to each operation mode.

9. A model railway traffic light control method for controlling a model railway traffic light apparatus which includes a sensor to detect a timing when a toy train which travels along a rail passes through a predetermined position, and a control section to switch at least one signal light in a predetermined series of light turning-on patterns the method comprising:

a first step beginning counting of a period when the sensor detects a first passing of the train;

a second step to specify a counted period when a second passing of the train occurs after the first passing; and a third step to set a switching interval of the switching according to the counted period.

10. The method as claimed in claim 9, wherein the third step is a step which sets the switching interval to be shorter when the counted period is shorter.

11. The method as claimed in claims 9 or 10, wherein the third step is a step which switches the light turning-on pattern in accordance with any one operation mode specified by a user from a plurality of different operation modes specifying the series of light turning-on patterns.

* * * * *